US006536760B1

(12) United States Patent
Spina et al.

(10) Patent No.: US 6,536,760 B1
(45) Date of Patent: Mar. 25, 2003

(54) SHEET PROCESSING APPARATUS

(75) Inventors: John A. Spina, Hamlin, NY (US); John Depoint, Jr., Palmyra, NY (US); Marion T. Juskiewicz, Webster, NY (US); Steven P. Hivner, Fort Collins, CO (US)

(73) Assignee: Eastman Kodak Company, Rochester, NY (US)

( * ) Notice: Subject to any disclaimer, the term of this patent is extended or adjusted under 35 U.S.C. 154(b) by 135 days.

(21) Appl. No.: 09/635,376

(22) Filed: Aug. 9, 2000

(51) Int. Cl.[7] ..... B65H 31/00

(52) U.S. Cl. ..... 271/207; 271/171; 271/169

(58) Field of Search ..... 271/207, 171, 271/169, 223, 226, 236; 414/788.9

(56) References Cited

U.S. PATENT DOCUMENTS

| | | | | | |
|---|---|---|---|---|---|
| 3,753,560 | A | | 8/1973 | Kapral et al. | |
| 3,807,725 | A | | 4/1974 | Bookless | |
| 3,921,972 | A | | 11/1975 | Miller | |
| 4,032,136 | A | * | 6/1977 | Komaba et al. | 271/160 |
| 4,570,757 | A | | 2/1986 | Marzullo | |
| 4,697,803 | A | * | 10/1987 | Kan et al. | 271/127 |
| 4,786,042 | A | | 11/1988 | Stemmle | |
| 4,971,311 | A | | 11/1990 | Tsukimoto | |
| 5,110,106 | A | * | 5/1992 | Matsumura et al. | 271/171 X |
| 5,172,902 | A | | 12/1992 | Hashimoto et al. | |
| 5,398,931 | A | * | 3/1995 | Tohgoh | 271/126 |
| 5,423,656 | A | * | 6/1995 | Filsinger et al. | 271/223 |
| 5,476,254 | A | | 12/1995 | Golicz | |
| 5,647,585 | A | * | 7/1997 | Cheong | 271/171 |
| 5,713,570 | A | | 2/1998 | Ouchi | |
| 5,746,571 | A | * | 5/1998 | Dietschi et al. | 271/171 X |
| 5,927,707 | A | * | 7/1999 | Miura | 271/171 |
| 5,944,308 | A | * | 8/1999 | McLeod et al. | 271/145 X |

* cited by examiner

*Primary Examiner*—Christopher P. Ellis
*Assistant Examiner*—Richard Ridley
(74) *Attorney, Agent, or Firm*—Clyde E. Bailey, Sr.

(57) ABSTRACT

A sheet processing apparatus has an adjustable tray for receiving and storing paper, such as photographic paper, has adjustable sheet width aligning and sheet receiving guide members that can alignably accommodate various sizes of paper. Independent quick release/latch mechanisms enable easy and quick deployment of the adjustable sheet width aligning and sheet receiving guide members.

7 Claims, 7 Drawing Sheets

SHEET PROCESSING APPARATUS

CROSS-REFERENCE TO RELATED APPLICATIONS

The present application is related to U.S. application Ser. No. 09/635,819, filed Aug. 9, 2000, by Spina et al., and entitled, "Adjustable Tray and Method for Receiving and Storing Sheets of Web Material".

FIELD OF THE INVENTION

The invention relates generally to an apparatus for processing sheets of web material. More particularly the invention concerns an apparatus for processing sheets of web material, such as photographic film or paper, having an adjustable tray for receiving and storing paper having various paper size configurations.

BACKGROUND OF THE INVENTION

Devices for storing and feeding sheets of paper are well known in the art. Such devices are commonly found in document processing equipment, such as copier machines, where sheets of paper are fed from a tray to an image development system where a pre-selected image is formed on the paper. Among several illustrative examples of this type of development are the ones disclosed in, for instance: U.S. Pat. No. 5,172,902, Dec. 22, 1992, titled "Paper Storing Device With A Swingable Engaging Member And An Engaging/Detaching Mechanism," by Hashimoto, et al.; U.S. Pat. No. 3,921,972, Nov. 25, 1975, titled "Sheet Stack Receptacle," by Miller; U.S. Pat. No. 5,713,570, Feb. 3, 1998, titled "Paper supply Cassette And Paper Supply Device Having Paper Supply Cassette," by Ouchi; U.S. Pat. No. 3,753,560, Aug. 21, 1973, titled "Auxiliary Sheet Feeder," by Kapral et al.; and, U.S. Pat. No. 4,971,311, Nov. 20, 1990, titled "Feeder For Sheet-Feed Printing Machine," by Tsukimoto. The developments in the patents contemplate sheets of paper being fed from the tray to a processing device, such as a copier machine. However, to the surprise of the inventors, there appears to be no references that teach or suggest an adjustable tray into which paper of various sizes is alignably fed and stacked. Such applications could include sheets of paper fed from paper processing equipment, such as a chopper or slitter. The processed paper would then be stacked in the tray having novel and unobvious adjustable features for receiving paper of different dimensions and moved further down stream in a stacked array for further processing, such as inspection and packaging.

An existing practice for processing sheets of paper after processing includes feeding the sheets (from an MSC chopper) into bins on an indexing conveyor. A shortcoming of this practice is that a full-time operator is required to remove each pack or stack of sheets as it was indexed to the last position. These packs are generally very cumbersome and can be as large as 35 mm×43 mm and could weigh 12 lbs. Moreover, the height of the index conveyor is awkwardly high (upwards of 42 inches) which causes ergonomic problems for the operator. The packs or stacks of paper had to then be accumulated on boards and then later transported to the next operation.

Therefore, a need persists in the art for an apparatus for processing sheets of paper that incorporates an adjustable tray for receiving and storing sheets of paper of various widths and lengths, and that enables quick adjustments to reduce sheet processing cycle time.

SUMMARY OF THE INVENTION

It is therefore an object of the invention to provide an apparatus for processing sheets of paper having a tray that can receive and store sheets of paper having a predetermined width and length.

It is another object of the invention to provide an apparatus in which the tray has a quick release and latch members for controlling width and length guide elements.

The present invention is directed to overcoming one or more of the problems set forth above. Briefly summarized, according to one aspect of the present invention, a sheet processing apparatus, comprises: a sheet feeding member; a sheet processing element arranged for receiving a sheet to be processed; an adjustable tray member for receiving and storing sheets processed, said adjustable tray member including: a platform for stacking sheets of paper; a first lateral edge guide arranged substantially normal to a second lateral edge guide each being supported on said platform; a sheet width aligning guide member and a cooperating sheet receiving guide member, said sheet width aligning guide member being arranged for adjustable movements along a first axis of said platform towards and away from said first lateral edge guide, and said cooperating sheet receiving guide member being arranged for adjustable movements along a second axis of said platform towards and away from said second lateral edge guide; and, means for removing said sheets from said adjustable tray for subsequent processing.

There are numerous advantageous effects of the present invention, including: the width of the product processed by the tray does not have to be equivalent to the length; the tray can accommodate various size configurations via use of a custom designed quick release/latch clip; the tray allows operator access for quick and easy removal of the product; and, the tray design allows sheets to be fed from a proprietary chopping machine into the trays in such a manner as to stack the sheets uniformly with the sheet edges aligned, leaving no loose or wedged sheets.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
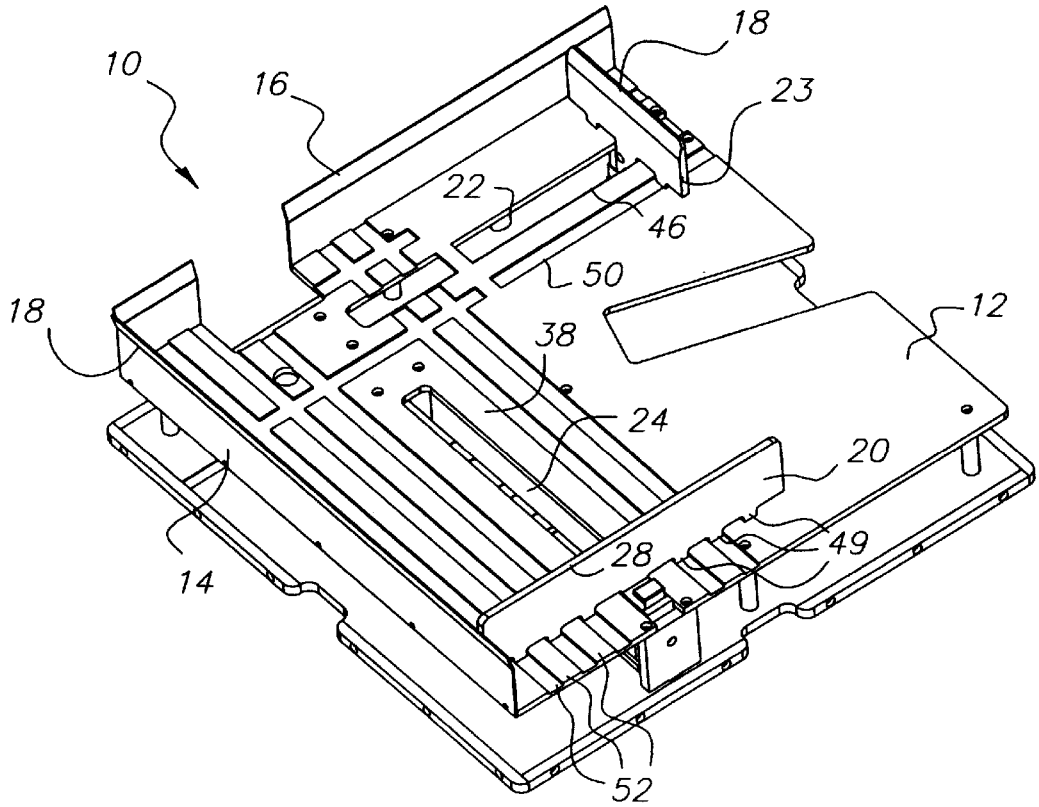
FIG. 1 is an isometric view of the outer top components of the tray.
Figure 2:
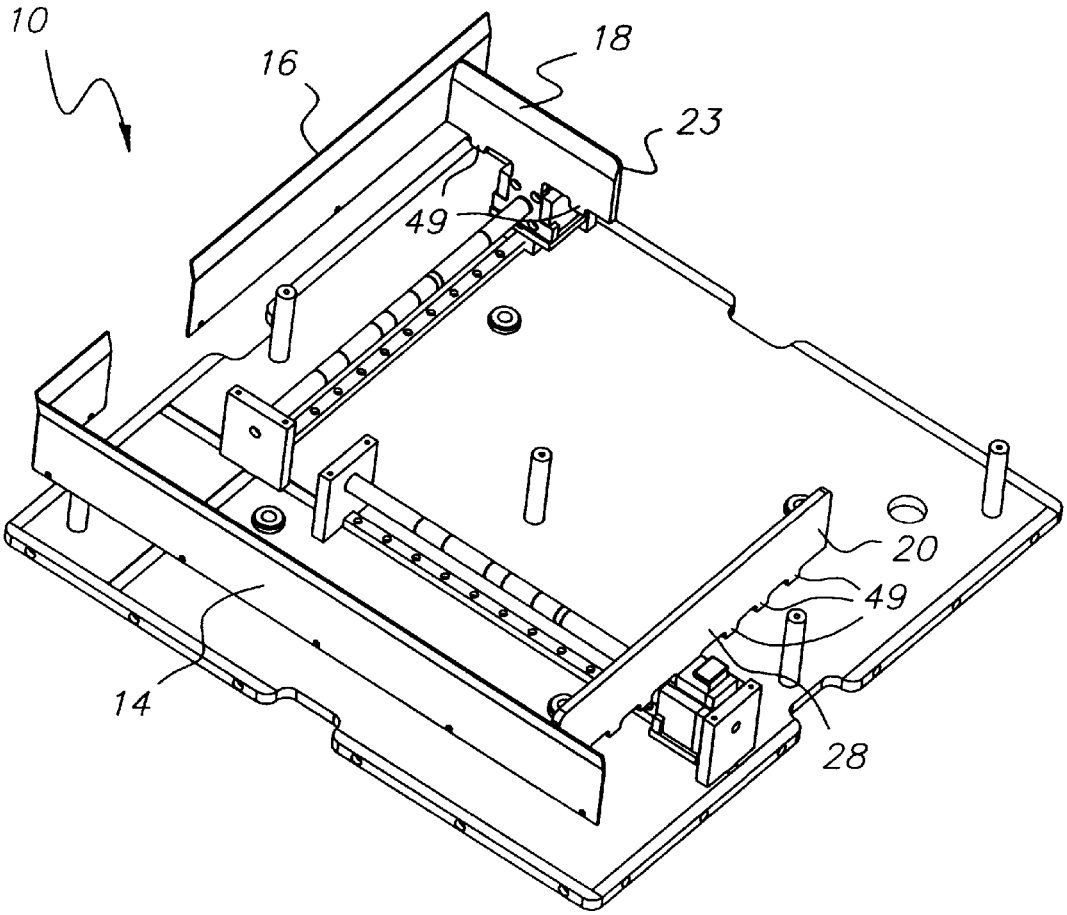
FIG. 2 is an isometric view of the internal components of the tray.

Turning now to the drawings, and in particular to FIGS. 1 and 2, the adjustable tray 10 of the invention is illustrated.

Broadly defined, adjustable tray 10 for receiving and storing sheets of web material 1, such as photographic film and paper, having a predetermined width (w) and length (l) includes a platform 12 for stacking sheets of web material or paper 1. According to FIGS. 1 and 2, a first lateral edge guide 14 and a second lateral edge guide 16, both preferably fixed, are supported on platform 12. First lateral edge guide 14 is arranged substantially normal to second lateral edge guide 16 for alignably supporting the stack of sheets of web material or paper 1 being received by platform 12.

Referring again to FIGS. 1 and 2, sheet width aligning guide member 18 cooperates along platform 12 with an adjustable sheet receiving guide member 20. Sheet width aligning guide member 18 is arranged for adjustable movements along a first axis 22 of platform 12 towards and away from the first lateral guide 14 for alignably accommodating a predetermined width (w) of the sheet of web material or paper 1 being fed to adjustable tray 10. In a preferred embodiment, sheet width aligning guide member 18 is substantially tapered along a top edge 23.

Still referring to FIGS. 1 and 2, sheet receiving guide member 20 is arranged for adjustable movements along a second axis 24 of platform 12 towards and away from second lateral edge guide 16. In addition to being the first point of contact of sheets of web material or paper 1 fed to adjustable tray 10 (discussed below), sheet receiving guide member 20 enables the platform 12 to alignably accommodate sheets of web material or paper 1 having a predetermined length (l). In a preferred embodiment, sheet receiving guide member 20 is substantially flat along a top edge 28.

Figure 3:
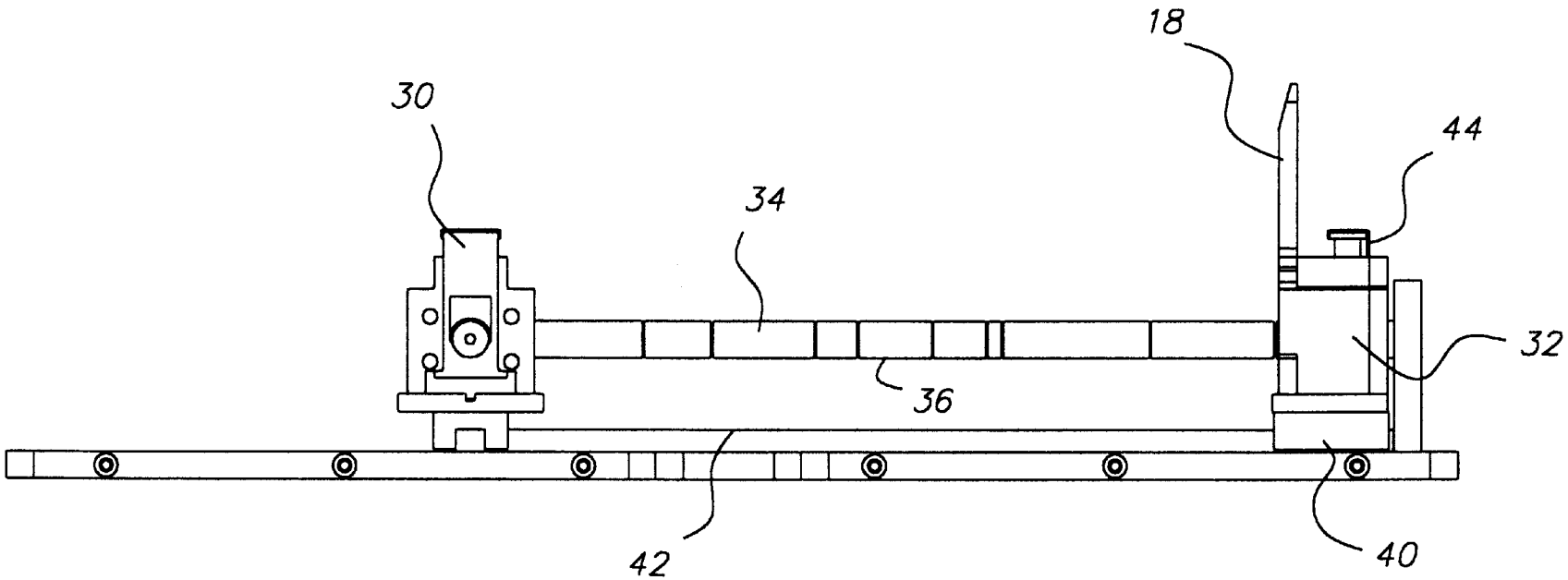
FIG. 3 is a partial side view of the adjustment mechanism for the adjustable guides.

Referring now to FIG. 3, adjustable tray 10 further includes a first quick release/latch member 30 operably associated with the sheet width aligning guide member 18. First quick release/latch member 30 is provided for releasing the sheet width aligning guide member 18 from a first position along the first axis 22 and then securing the sheet width aligning guide member 18 in a second position along the first axis 22.

Similarly, a second quick release/latch member (not shown) is operably associated with the sheet receiving guide member 20. Second quick release/latch member is provided for releasing the sheet receiving guide member 20 from a first position along the second axis 24 and then securing the sheet receiving guide member 20 in a second position along the second axis 24.

According to FIG. 3, preferably, first quick release/latch member 30 is supported in a housing 32 for releasing and latching the sheet width aligning guide member 18 by an adjustable rod 34. Adjustable rod 34 has a plurality of slots 36 for engaging first quick release/latch member 30 in a plurality of positions along platform 12. Although not shown, second quick release/latch member governing the sheet receiving guide member 20 has a similar adjustable rod (not shown) and a plurality of slots (not shown) for engaging the second quick release/latch member in a plurality of positions along the platform 12. A return spring 44 supportedly mounted in housing 32 biases the sheet width aligning guide member 18. Similarly, a return spring (not shown) biases the sheet receiving guide member 20. Both the guide members 18, 20 are adjusted by pressing the custom quick release/latch member 30 (only one shown) and sliding the guide members 18, 20 to the discrete adjustment slots 36 along the adjustment rod 34 until the interface of the quick release/latch member 30 and slots 36 in adjustment rod 34 engage, as shown in FIG. 3.

Referring still to FIG. 3, skilled artisans will appreciate that to achieve smooth movement of the guide members 18, 20, some sort of bearing 40 and a bearing rail 42 supporting the bearing 40 may be operably associated with each of the sheet width aligning guide member 18 and sheet receiving guide member 20 (only one bearing arrangement shown).

In an alternative embodiment, adjustable tray 10 for receiving and storing sheets of web material 1 having a predetermined width (w) and length (l) includes platform 12 (as described above) for stacking sheets of web material or paper 1. According to FIGS. 1 and 2, platform 12 has a first guide slot 38 substantially normal to a second guide slot 46.

Referring to FIGS. 1 and 2, first lateral edge guide 14 is substantially parallel to the first guide slot 38 and the second lateral edge guide 16 is substantially parallel to the second guide slot 46.

Referring to FIGS. 1 and 2, sheet width aligning guide member 18 having a plurality of tabs 49 along a bottom edge may be disposed for slidable movements in both a plurality of first grooves 50 formed in the platform 12 and in the second guide slot 46. Similarly, sheet receiving guide member 20 having a plurality of spaced first tabs 49 along a bottom edge may be disposed for movement along grooves 52 formed in platform 12 and in the first guide slot 38. Grooves 50, 52, guide members 18, 20, respectively, and tabs 49 form a rake/slot interface that prevent sheets of web material or paper 1 from inadvertently becoming wedged between the guide members 18, 20 and the platform 12, as shown in FIG. 1.

In yet another embodiment of the invention, a method of feeding sheets of web material or paper 1 into an adjustable tray 10 includes providing the adjustable tray 10, as described in detail above. At least one sheet of web material or paper 1 for feeding into the tray 10 is provided and positioned for feeding.

Figure 4:
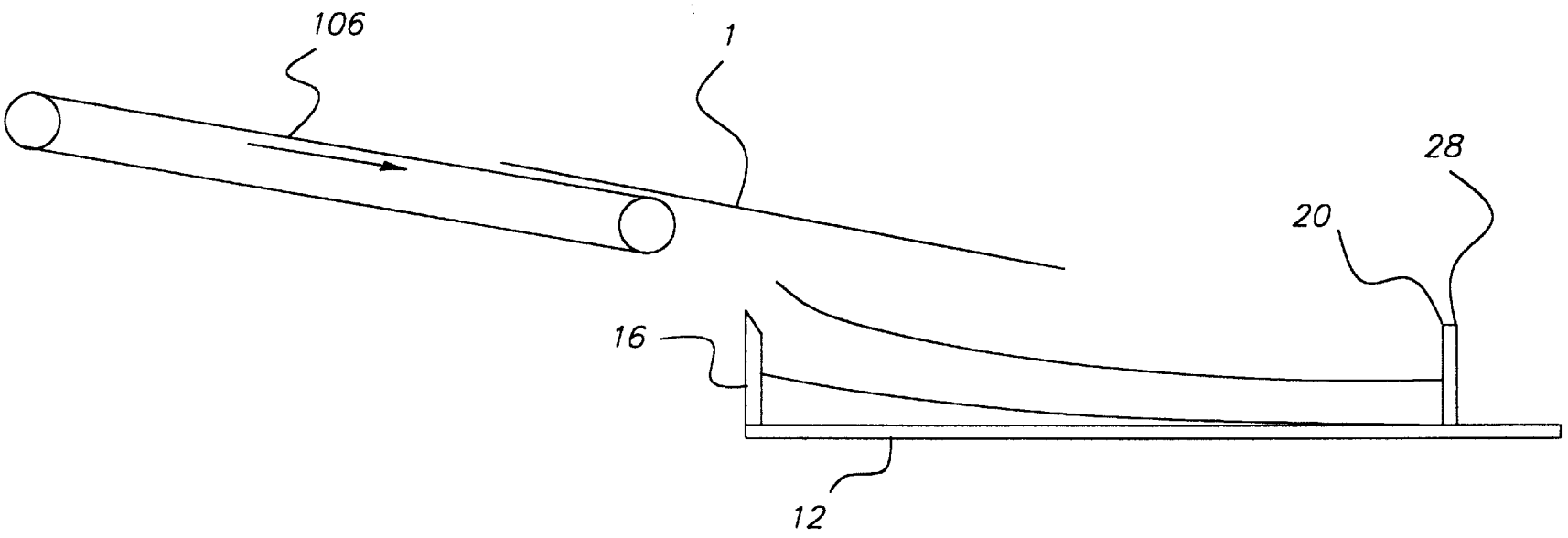
FIG. 4 is an elevated side view of the sheets being fed from typical sheet processing equipment into the adjustable tray.

Referring to FIGS. 1 and 4, the sheet width aligning guide member 18 and sheet receiving guide member 20 (as described above) are preset to correspond to a predetermined width and length of the sheets of web material or paper 1 being fed. The sheets of web material or paper 1 being fed are positioned relative to a top edge 28 of the sheet receiving guide member 20 of tray 10. Once this is achieved, a leading edge of at least one sheet is directed downwardly towards the sheet receiving guide member 20 until the at least one sheet settles on the platform 12 between the first lateral edge guide 14, the second lateral edge guide 16, and the sheet width aligning guide member 18.

Figure 5:
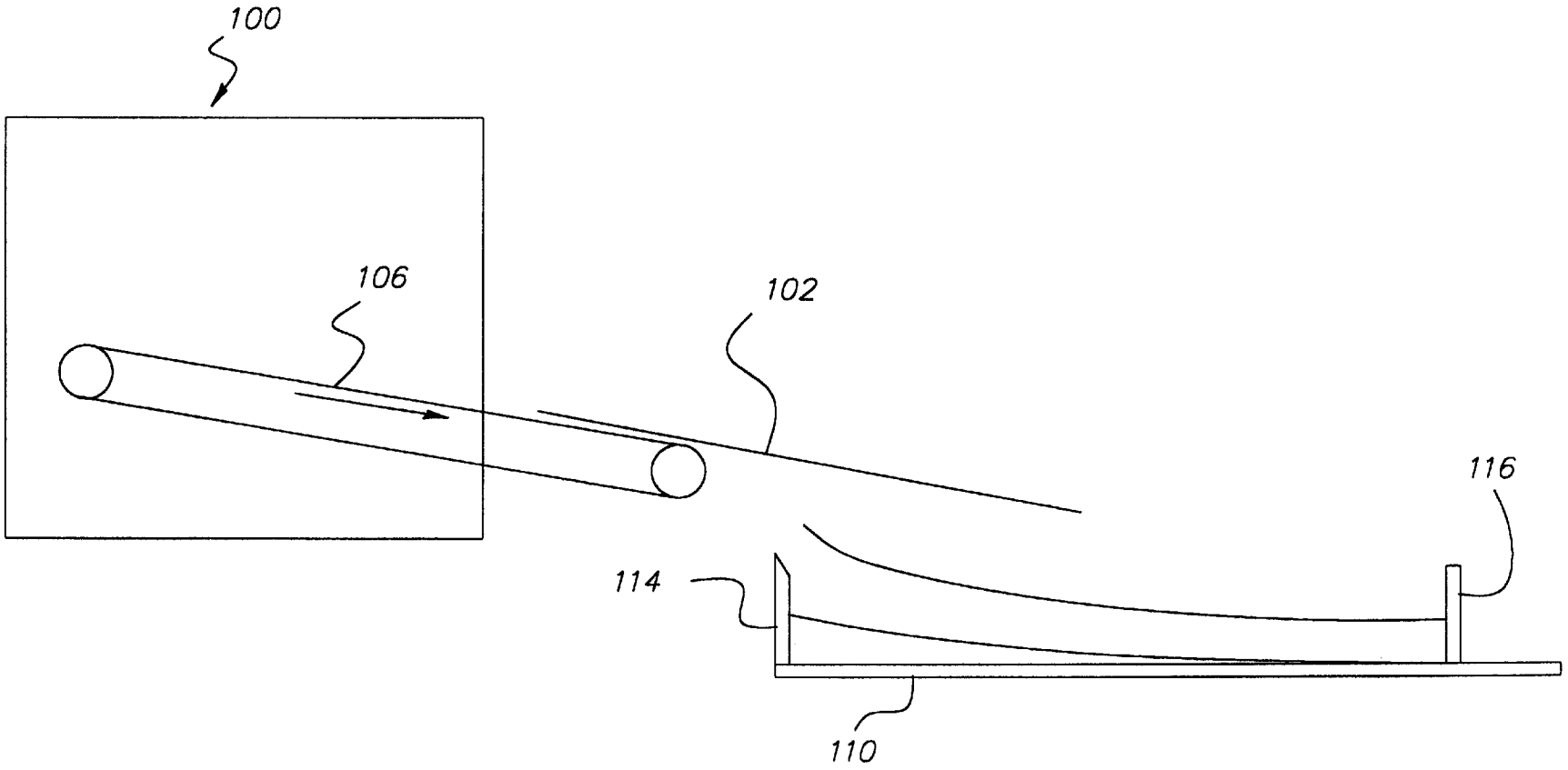
FIG. 5 is a side elevated view of the sheets fed singly from a processing apparatus of the invention into the adjustable tray.
Figure 6:
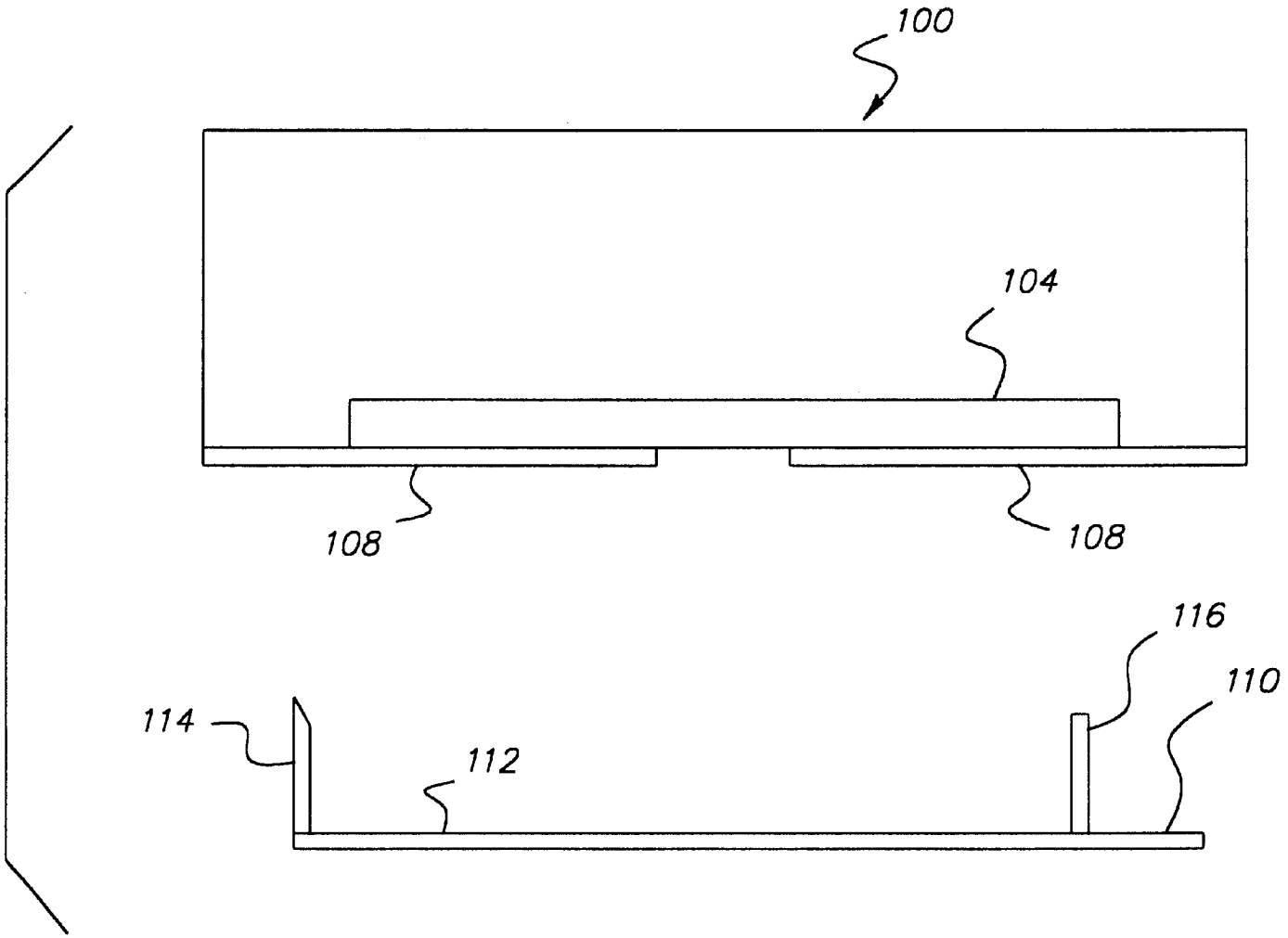
FIG. 6 is a side elevated view of the apparatus positioned to dump a stack of processed sheets into the adjustable tray; and, FIG. 7 is a side elevated view of the apparatus of FIG. 6 with the stack of sheets positioned on the adjustable tray.
Figure 7:
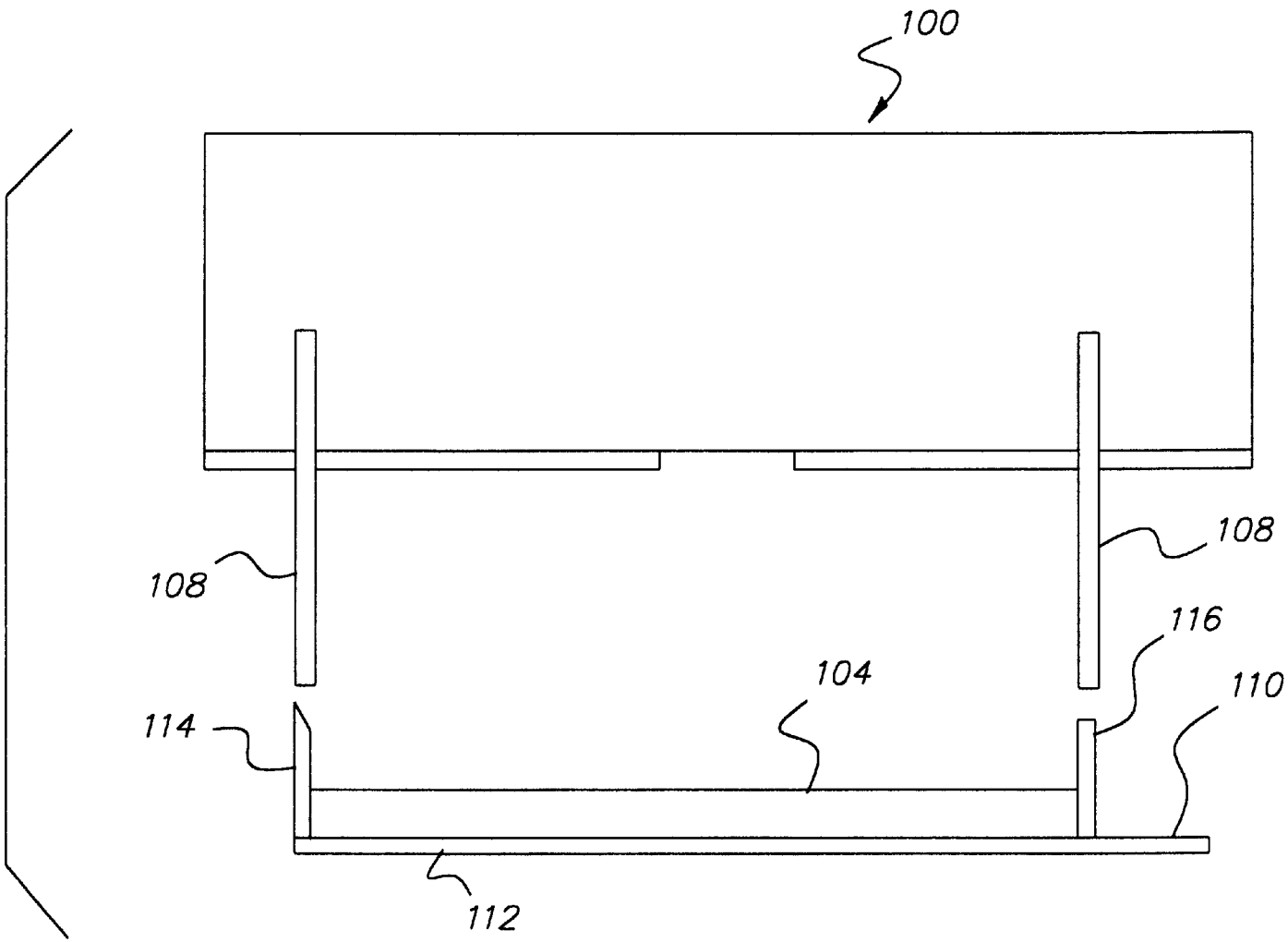

Referring to FIGS. 5–7, in an alternative embodiment of the invention, an apparatus 100 for processing sheets of web material or paper 102, such as a chopper, cuts sheets of photographic paper or film to a predetermined length and width and then delivers the cut sheets of web material or paper 102 to an adjustable tray 110 (as described above) for further processing. Generally, apparatus 100 may accommodate a large diameter of roll product, such as film or paper, which is fed into apparatus 100 for processing. According to FIG. 5, the cut sheets of web material or paper 102 processed in apparatus 100 of the invention may be accumulated singly onto a conveyor 106 (FIG. 4) and then fed into adjustable tray 110. Alternatively, as shown in FIG. 6, the sheets of web material or paper 102 may be accumulated into a stack 104 and the entire stack 104 may be dumped via openable doors 108 onto platform 112 of adjustable tray 110 between second lateral edge guide 114 and sheet receiving guide member 116, as shown in FIG. 7. In either embodiment, the adjustable tray 110 of apparatus 100 is positioned in such a manner as to allow all the sheets of web material or paper 102 to settle into a stack 104 on platform 112 within the adjustable tray 110, as described above.

The invention has been described with reference to a preferred embodiment. However, it will be appreciated that variations and modifications can be effected by a person of ordinary skill in the art without departing from the scope of the invention.

PARTS LIST

1 sheets of web material
10 adjustable tray
12 platform
14 first lateral edge guide
16 second lateral edge guide
18 sheet width aligning guide member
20 sheet receiving guide member
22 first axis along platform 12
23 tapered top edge of guide member 18
24 second axis along platform 12
28 top edge of sheet receiving guide member 20
30 first quick release latch member
32 housing
34 adjustment rod
36 plurality of slots
38 first guide slot
40 bearing
42 bearing rail
44 return spring
46 second guide slot part identifying number 49 tabs.
50 plurality of second grooves
52 plurality of second grooves
100 apparatus for processing sheets of web material or paper
102 sheet of web material or paper
104 stack of sheets of web material or paper
106 conveyor
108 openable door
110 adjustable tray
112 platform
114 second lateral edge guide
116 sheet receiving guide member

What is claimed is:

1. A sheet processing apparatus, comprising:

a sheet feeding member;

a sheet processing element arranged for receiving a sheet to be processed;

an adjustable tray member for receiving and storing sheets processed, said adjustable tray member including:

a platform for stacking sheets of paper;

a first lateral edge guide arranged substantially normal to a second lateral edge guide each being supported on said platform;

a sheet width aligning guide member and a cooperating sheet receiving guide member, said sheet width aligning guide member having a plurality of spaced tabs along a bottom edge, each one of said plurality of spaced tabs extending at least partially through slots in said platform to retain sheets of paper on said platform, and wherein said sheet width aligning guide member being further arranged for adjustable movements along a first axis of said platform towards and away from said first lateral edge guide, and wherein said cooperating sheet receiving guide member being arranged for adjustable movements along a second axis of said platform towards and away from said second lateral edge guide, and, wherein a bearing and a bearing rail supporting said bearing are operably associated with said sheet width aligning member and said sheet receiving guide member enabling movement of said sheet width aligning member and said sheet receiving guide member; and, means for removing said sheets from said adjustable tray for subsequent processing.

2. The tray recited in claim 1 wherein said sheet width aligning guide member is substantially tapered along a top edge.

3. The tray recited in claim 1 wherein said cooperating sheet receiving guide member is substantially flat along a top edge.

4. The tray recited in claim 1 wherein a first quick release/latch member operably associated with said cooperating sheet receiving guide member is provided for releasing said cooperating sheet receiving guide member from a first position along said first axis and then securing said cooperating sheet receiving guide member in a second position along said first axis.

5. The tray recited in claim 1 wherein a second quick release/latch member operably associated with said sheet width aligning guide member is provided for releasing said sheet width aligning guide member from a first position along said second axis and then securing said sheet width aligning guide member in a second position along said second axis.

6. The tray recited in claim 4 wherein said first quick release/latch member is supported for releasing and latching said receiving guide member by an adjustable rod, said adjustable rod having a plurality of slots for engaging a clip affixed to said first quick release/latch member.

7. A sheet processing apparatus, comprising:

a sheet feeding member;

a sheet processing element arranged for receiving a sheet to be processed;

an adjustable tray member for receiving and storing sheets processed, said adjustable tray member including:

a platform for stacking sheets of paper;

a first lateral edge guide arranged substantially normal to a second lateral edge guide each being supported on said platform;

a sheet width aligning guide member and a cooperating sheet receiving guide member, said sheet width aligning guide member having a plurality of spaced first tabs along a first bottom edge, each one of said plurality of spaced first tabs extending at least partially through first slots in said platform to retain sheets of paper on said platform, and wherein said sheet width aligning guide member being further arranged for adjustable movements along a first axis of said platform towards and away from said first lateral edge guide, and wherein said cooperating sheet receiving guide having a plurality of spaced second tabs along a second bottom edge, each one of said plurality of spaced second tabs extending at least partially through slots in said platform to retain sheets of paper on said platform member, and wherein said cooperating sheet receiving guide further being arranged for adjustable movements along a second axis of said platform towards and away from said second lateral edge guide;

a bearing and a bearing rail supporting said bearing are operably associated with said sheet width aligning member and said sheet receiving guide member enabling movement of said sheet width aligning member and said sheet receiving guide member; and, means for removing said sheets from said adjustable tray for subsequent processing.

* * * * *